US005333432A

United States Patent [19]

Schlüter

[11] Patent Number: 5,333,432

[45] Date of Patent: Aug. 2, 1994

[54] DEVICE FOR FORMING AN EXPANSION JOINT IN A FLOOR COVERED WITH CERAMIC TILES

[75] Inventor: Werner Schlüter, Iserlohn, Fed. Rep. of Germany

[73] Assignee: Schluter Systems GmbH, Iserlohn, Fed. Rep. of Germany

[21] Appl. No.: 985,888

[22] Filed: Dec. 4, 1992

[30] Foreign Application Priority Data

Dec. 13, 1991 [DE] Fed. Rep. of Germany ..... 4141138

[51] Int. Cl.[5] ..... E04F 15/14

[52] U.S. Cl. ..... 52/396.1; 404/64

[58] Field of Search ..... 52/396, 403, 573; 404/54, 64, 65

[56] References Cited

U.S. PATENT DOCUMENTS

| | | | |
|---|---|---|---|
| 4,191,489 | 3/1980 | Ray et al. | 52/396 X |
| 4,288,173 | 9/1981 | Nick | 52/396 X |
| 4,601,604 | 7/1986 | Clark et al. | 52/396 X |
| 4,651,488 | 3/1987 | Nicholas et al. | 52/396 |

FOREIGN PATENT DOCUMENTS

| | | | |
|---|---|---|---|
| 10883 | 5/1980 | European Pat. Off. | 52/403 |
| 165611 | 12/1985 | European Pat. Off. | 52/396 |
| 2249879 | 4/1974 | Fed. Rep. of Germany | 52/396 |
| 3701220 | 7/1988 | Fed. Rep. of Germany . | |
| 2307091 | 11/1976 | France | 52/396 |
| 2171428 | 8/1986 | United Kingdom | 52/396 |

OTHER PUBLICATIONS

German Design Patent Application No. G 85 02 738 3, Nov. 1985.

*Primary Examiner*—Peter M. Cuomo
*Assistant Examiner*—Jerry Redman
*Attorney, Agent, or Firm*—Collard & Roe

[57] ABSTRACT

A device for forming an expansion joint in a floor covered with ceramic tiles includes a first plastic angle floor section to be secured onto the floor and formed by a fastening leg and terminating leg, and a second plastic wall section shaped like a strip with interlocking elements on its outer side. Both sections are connected by an upper soft plastic bridge simultaneously covering the respective section segments from the top. In the lower portion of the device, there is a bridge which is a predetermined tearing bridge or support bridge bonded only on one side. The device serves for forming an expansion joint in the transition zone which connects and bridges a wall to a floor covered with ceramic tiles.

7 Claims, 1 Drawing Sheet

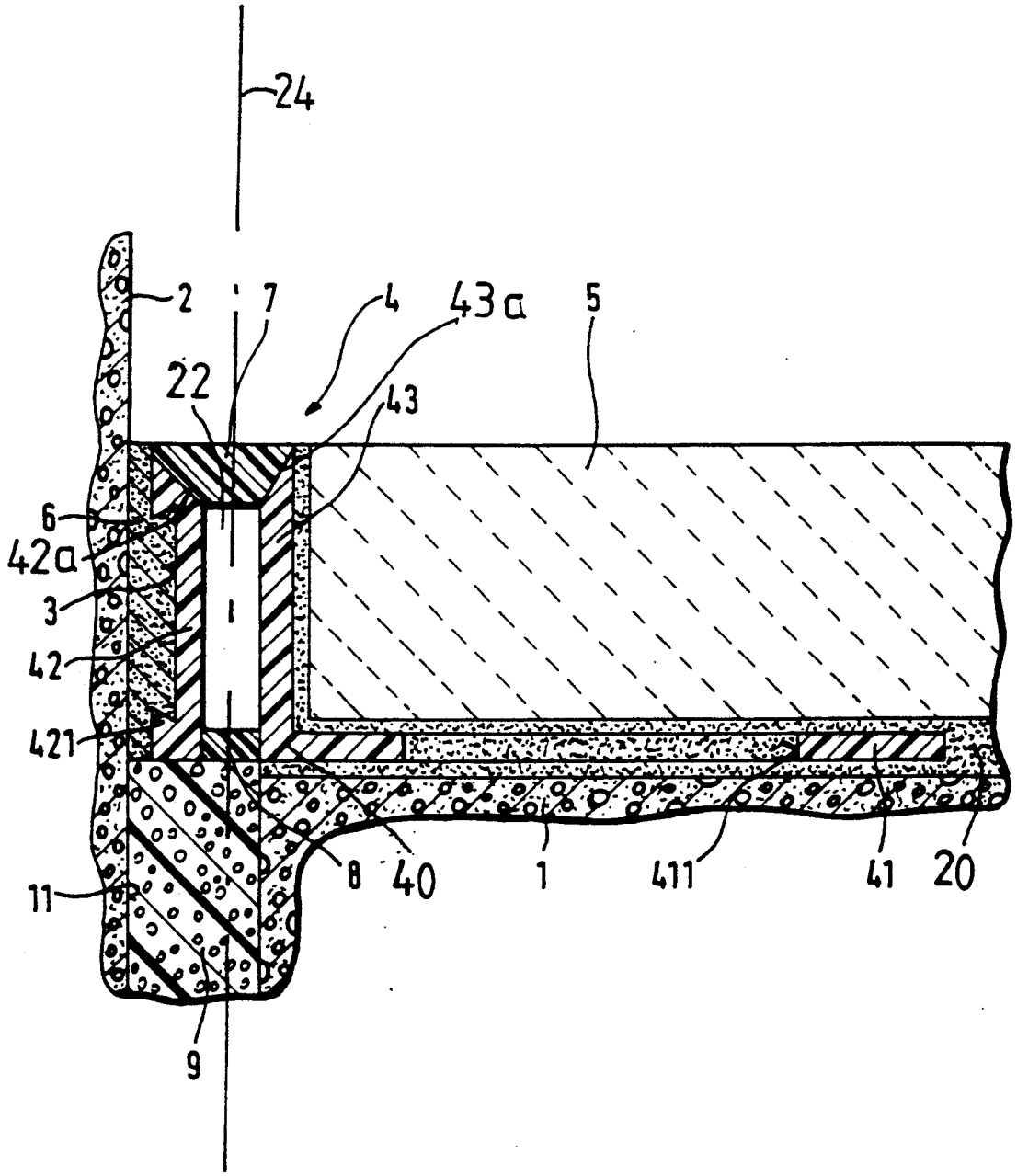
24
2
7
4
43a
5
22
43
6
42a
3
42
421
11
8
40
1
411
41
20
9

DEVICE FOR FORMING AN EXPANSION JOINT IN A FLOOR COVERED WITH CERAMIC TILES

BACKGROUND OF THE INVENTION

1. Field of the Invention

The present invention relates to a device for forming an expansion joint in a floor covered with ceramic tiles, in which the device includes a first plastic floor angle section or bracket to be secured onto the floor and formed by a fastening leg and a terminating leg, and a second plastic wall section connected with the terminating leg of the first plastic floor angle section by way of an upper and a lower elastic soft plastic bridge.

2. The Prior Art

For forming an expansion joint between two floor sections which are preferably covered with ceramic tiles, a device is known from German design patent No. DE-GM 85 02 738, which is formed by two angle sections made of plastic material. On their terminating legs, which are arranged parallel with one another with a spacing therebetween, the angle sections are connected both at the top and at the bottom by elastic soft plastic bridges, forming a hollow space. The respective fastening legs, which can be accommodated in an adhesive layer beneath the ceramic tiles, have a rectangular cross-section and a thickness of less than 1.5 mm.

Furthermore, a box-shaped plastic section for forming stress-relieving joints in floors and walls is known from German Patent No. DE-OS 37 01 220, in connection with which the section has recoiling side walls made of hard plastic material. These side walls are fitted with outer interlocking elements and are connected by elastic soft plastic bridges. In this regard, an upper plastic bridge covers the face sides of the side walls, which would otherwise be visible from the outside.

SUMMARY OF THE INVENTION

It is an object of the present invention to provide a device for forming an expansion joint in the transition zone bridge area connecting a wall to a floor, which floor is covered with ceramic tiles, whereby recycled plastic material could be utilized in significant amounts.

This object is achieved according to the present invention by providing a device for forming an expansion joint in the transition zone between a wall and a floor with the floor being covered with ceramic tiles, comprising a first plastic floor angle section having a fastening leg for securing the section to the floor and having a terminating leg, the terminating leg having a top surface; a second plastic wall section for being fastened in use to a wall, the second wall section having a top surface; an upper elastic soft plastic bridge and a lower elastic soft plastic bridge connecting the second wall section with the terminating leg of the first plastic floor angle section; the second plastic wall section comprising a strip having an outer side with an interlocking element on the outer side; the upper soft plastic bridge covering the second wall section top surface and the terminating leg top surface while connecting them with one another; the lower bridge being a predetermined tearing bridge or comprising a support bridge bonded on only one side; the device having a longitudinal axis; and said second plastic wall section having a height.

Without requiring additional fastening elements, the device according to the invention, which can be manufactured as a one-piece molded plastic part, can be secured within the bridging zone of the joint formed between a wall and the floor covered with ceramic tiles. In a manner known, the attachment of the leg of the first plastic floor angle section or bracket to the floor substrate is accomplished by utilizing an adhesive layer which also adheres to tiles. The second plastic wall section, which is constructed in the shape of a strip, can be secured onto the wall with the use of interlocking elements.

Movements occurring, for example, due to thermal stresses between the wall and the floor, are absorbed by the device according to the invention. Even if there should be much greater movement between the floor and the wall, adequate clearance will still be available in the lower zone of the device. This is because of the use of a bridge having a predetermined strength that resists tearing or the use of a unilaterally linked support bridge. This structure maintains intact a hollow space present in the device which permits movement while keeping the wall section apart from the floor section. An upper covering of a soft plastic bridge permits the use of recycled material, since only the bridge is visible from the outside. The bridge is made of uniformly colorfast plastic material which, for example, is attached by extrusion.

A preferred embodiment of the invention is wherein an interlocking element is located on the outer side of the second plastic wall section in the longitudinal axis direction and comprises an undercut groove substantially covering the height of the second plastic wall section.

BRIEF DESCRIPTION OF THE DRAWING

Other objects and features of the present invention will become apparent from the following detailed description considered in connection with the accompanying drawing which discloses one embodiment of the present invention. It should be understood, however, that the drawing is designed for the purpose of illustration only and not as a definition of the limits of the invention.

DETAILED DESCRIPTION OF THE PREFERRED EMBODIMENT

Turning now in detail to the drawing, the figure shows that between the floor 1 and the abutting wall 2, an expansion joint or bridge is formed, with this bridge device denoted as a whole by reference numeral 4. This expansion joint 4 is a continuation of the joint that is extended further downwardly into the floor 1. In this connection, the floor joint 11 can be filled with a strip 9, which is comprised of, for example, polystyrene foam which is sold under the trademark STYROPOR.

For fastening the bridging device onto the floor, the device 4 has an angle floor section or bracket 40 made of a hard material, such as hard plastic or metal, of which floor section 40 has a fastening leg 41 which is surrounded by adhesive layer 20 beneath the ceramic tile 5. The adhesive 20 penetrates the perforations and apertures 411 in the leg 41. Fastening leg 41 is continuously and integrally connected at a right angle to the terminating leg 43 made of hard plastic material. The ceramic tile 5 is attached by the adhesive 20 simultaneously to leg 41 and to leg 43 of the floor section 40.

For fastening the joint 4 onto the wall, a second wall section 42 made of a hard plastic or metal is used which is formed into the shape of a strip. Section 42 may be made of a hard plastic material. This second wall section 42 has a dovetailed undercut groove 3 on the outer side. The legs of the groove are denoted by the reference numeral 421. The mortar 6 penetrates the dovetailed undercut groove 3 in an interlocking manner in the direction of longitudinal axis 24. In this manner, the wall section 42 is bonded to the wall 2. The wall section 42 and the terminating leg 43 of the floor angle section are positioned a spaced distance apart and are connected by the upper soft plastic bridge 7 and the lower soft plastic bridge 8. Bridge 8 is made from a material having a predetermined tearing strength. A hollow space 22 is formed between wall section 42, leg 43, and bridges 7 and 8. Hollow space 22 permits any necessary movement that may occur due to temperature changes or vibrations in the floor or in the wall to take place without damage to the joint. The upper bridge 7 simultaneously covers the upper face side 42*a* of the wall section 42, and of the upper face side 43*a* of the terminating leg 43. The lower bridge 8 also may be bonded only on one side, in which case it serves as a support bridge during the expansion of the respective floor field.

The hard plastic material can be made of a thermoplastic such as a polyolefin, such as polyethylene, polyvinyl chloride, or a thermosetting resin such as a phenol formaldehyde resin. The hard metal can be aluminum, brass, or steel.

While only one embodiment of the present invention have been shown and described, it is to be understood that many changes and modifications may be made thereunto without departing from the spirit and scope of the invention as defined in the appended claims.

What is claimed is:

1. A device for forming an expansion joint in the transition zone between a wall and a floor with said floor covered with ceramic tiles, said expansion joint being adjacent to said wall, comprising:

a first floor angle section having a fastening leg for securing the section to the floor and having a terminating leg, said terminating leg having a top surface;

a second wall section for being fastened in use to a wall, said second wall section having a top surface;

an upper elastic soft plastic bridge and a lower elastic soft plastic bridge connecting said second wall section with the terminating leg of said first floor angle section;

said second wall section comprising a strip having an outer side with an interlocking element on said outer side;

said upper soft plastic bridge covering said second wall section top surface and said terminating leg top surface while connecting them with one another;

said lower bridge being a predetermined tearing bridge or comprising a support bridge bonded on only one side;

said device having a longitudinal axis; and said second plastic wall section having a height.

2. The device according to claim 1, wherein said interlocking element is on the outer side of the second plastic wall section in the longitudinal axis direction and comprises an undercut groove substantially covering the height of the second plastic wall section.

3. The device according to claim 2, wherein said interlocking element comprises a groove having a dovetailed cross-section.

4. The device according to claim 1, wherein said first floor angle section is plastic.

5. The device according to claim 1, wherein said second wall section is plastic.

6. A device for forming an expansion joint in the transition zone between a wall and a floor with said floor covered with ceramic tiles, said expansion joint being adjacent to said wall, comprising:

a first floor angle section having a fastening leg for securing the section to the floor and having a terminating leg, said terminating leg having a top surface;

a second wall section for being fastened in use to a wall, said second wall section having a top surface;

an upper elastic soft plastic bridge and a lower elastic soft plastic bridge connecting said second wall section with the terminating leg of said first floor angle section;

said second wall section comprising a strip having an outer side with an interlocking element on said outer side;

said upper soft plastic bridge covering said second wall section top surface and said terminating leg top surface while connecting them with one another;

said lower bridge comprising a support bridge bonded on only one side;

said device having a longitudinal axis;

said second plastic wall section having a height; and wherein said interlocking element is on the outer side of the second plastic wall section in the longitudinal axis direction and comprises an undercut groove substantially covering the height of the second plastic wall section.

7. The device according to claim 6, wherein said interlocking element comprises a groove having a dovetailed cross-section.

* * * * *